US005921549A

United States Patent [19]

Wilson et al.

[11] Patent Number: 5,921,549

[45] Date of Patent: Jul. 13, 1999

[54] METHOD OF PLAYING A MODIFIED POKER GAME

[76] Inventors: Leroy Wilson, 1352 Croes Ave., Bronx, N.Y. 10472; Wilbert White, 2811 Exterior St. #7K, New York, N.Y. 10463

[21] Appl. No.: 09/013,129

[22] Filed: Jan. 26, 1998

[51] Int. Cl.[6] ..... A63F 1/00

[52] U.S. Cl. ..... 273/292; 273/273

[58] Field of Search ..... 273/292, 274, 273/273; 463/13

[56] References Cited

U.S. PATENT DOCUMENTS

| | | | |
|---|---|---|---|
| 5,660,393 | 8/1997 | Dreger | 273/292 |
| 5,732,950 | 3/1998 | Moody | 273/292 |
| 5,816,916 | 10/1998 | Moody | 463/13 |

OTHER PUBLICATIONS

"Stealing Bundles", The Way To Play, by the Diagram Group, p. 310, 1975.

*Primary Examiner*—Benjamin H. Layno

[57] ABSTRACT

A new Method of Playing a Modified Poker Game for providing entertainment and a wagering opportunity to at least two players. The inventive game includes a first step wherein a dealer sets a betting amount and a poker hand is dealt to the remaining players who each ante the betting amount. The player with the winning poker hand then collects an anted amounts. Next the dealer deals a second set of cards one at a time. For each card drawn, the players compare their hands to the drawn card and for each card in their hand having an equivalent denomination to any drawn card, set aside a pre-determined multiple of the betting amount into a set aside amount. The dealer then deals a third set of cards one at a time. For each card drawn, the players compare their hands to the drawn card and for each card in their hand having an equivalent denomination to any drawn card, withdraw from the set aside amount, if any, a pre-determined multiple of the betting amount to form a net set aside amount. In the event the set aside amount is less than the amount to be withdrawn, the dealer pays the difference. The dealer then collects the net set aside amount from each player.

5 Claims, 2 Drawing Sheets

FIG. 2
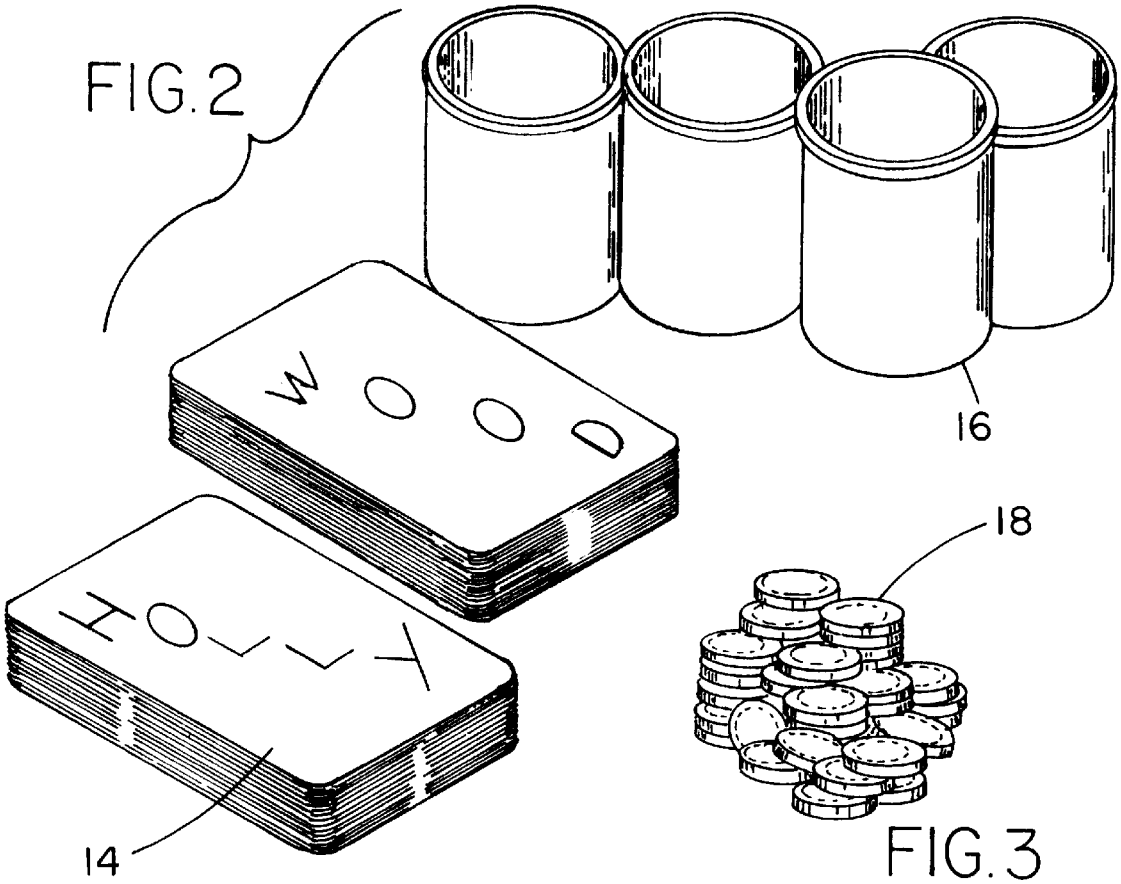
FIG. 3
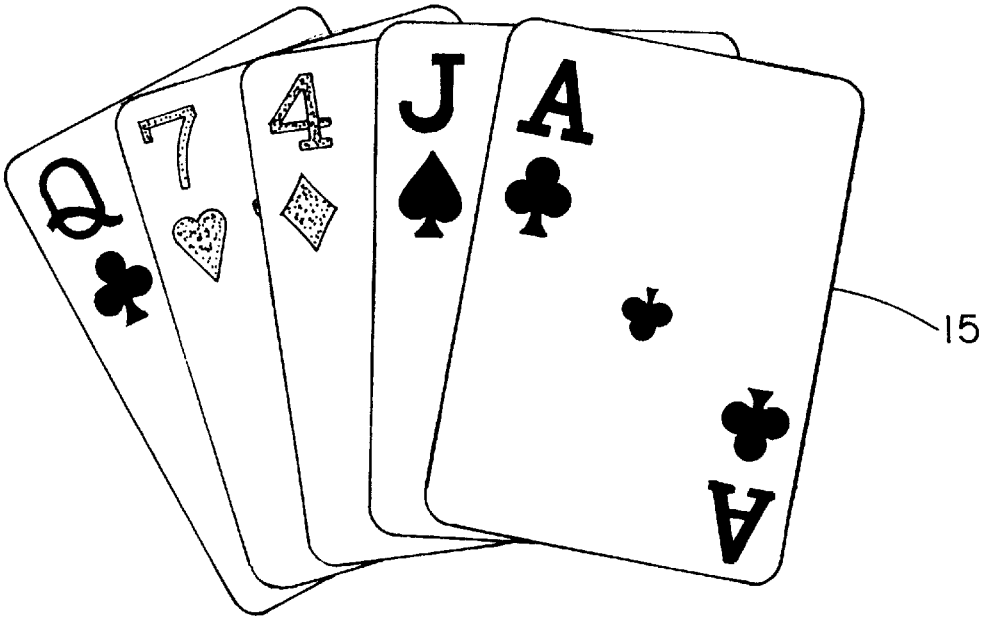
FIG. 4

METHOD OF PLAYING A MODIFIED POKER GAME

BACKGROUND OF THE INVENTION

1. Field of the Invention

The present invention relates to games of skill and chance and more particularly pertains to a new Method of Playing a Modified Poker Game for providing entertainment and a wagering opportunity to at least two players.

2. Description of the Prior Art

The use of games of skill and chance is known in the prior art. More specifically, games of skill and chance heretofore devised and utilized are known to consist basically of familiar, expected and obvious structural configurations and methods, notwithstanding the myriad of designs encompassed by the crowded prior art which have been developed for the fulfillment of countless objectives and requirements.

Known prior art games of skill and chance include U.S. Pat. No. 5,377,973; U.S. Pat. No. 5,382,025; U.S. Pat. No. 5,308,065; U.S. Pat. No. 4,743,022; U.S. Pat. No. 4,836,553 and U.S. Pat. Des. No. 243,414.

While these games fulfill their respective, particular objectives and requirements, the aforementioned patents do not disclose a new Method of Playing a Modified Poker Game. The inventive game includes the steps of:

selecting one player to act as a dealer;

the dealer determining a betting amount;

each player including the dealer anteing the betting amount;

the dealer dealing face up from a pre-determined number of decks a hand comprising a first pre-determined number of cards to each player including himself, each player comparing their hand to each of the hands of the other players using poker rank as the criterion for comparison;

the player with the hand having the highest poker rank collecting the anted betting amount from each of the other players;

the dealer dealing a second pre-determined number of cards equal to the first pre-determined number of cards one at a time;

for each of the second pre-determined number of cards drawn by the dealer, each player comparing the drawn card to their hand;

for each card in each player's hand having an equivalent denomination to a card in the second pre-determined number of cards, each player setting aside an amount corresponding to the betting amount multiplied by a pre-determined rank order, the amount so set aside adding up to a set aside amount;

the dealer dealing a third pre-determined number of cards equal to the first pre-determined number of cards one at a time;

for each of the third pre-determined number of cards drawn by the dealer, each player comparing the drawn card to their hand;

for each card in each player's hand having an equivalent denomination to a card in the third pre-determined number of cards, each player withdrawing from his set aside amount an amount corresponding to the betting amount multiplied by the pre-determined rank order, provided that, in the event the set aside amount is less than the amount corresponding to the betting amount multiplied by the pre-determined rank order, the dealer paying the player the difference, any amount remaining constituting a net set aside amount;

the dealer collecting from each player their set aside amount;

the dealer dealing a plurality of cards one at a time;

each player comparing their hand with the cards drawn and covering each card in their hand with a token representative of the betting amount as a card having an equivalent denomination is drawn until at least one winning player has covered all the cards in his hand;

the winning players signifying the covering of all of their cards and collecting an equal distribution of the tokens covering each of the player's cards;

the dealer dealing up to thirteen cards, one at a time, for each card so dealt, the dealer trying to guess its' denomination;

the dealer having the option of collecting from each player the value of a card guessed correctly multiplied by the betting amount or continuing until all thirteen cards are dealt, the dealer collecting at most once from the each player; and wherein aces are valued at one, kings are valued at thirteen, queens are valued at twelve, jack are valued at eleven and all remaining cards are valued at their face value.

In these respects, the Method of Playing a Modified Poker Game according to the present invention substantially departs from the conventional concepts and designs of the prior art, and in so doing provides an game primarily developed for the purpose of providing entertainment and a wagering opportunity to at least two players.

SUMMARY OF THE INVENTION

In view of the foregoing disadvantages inherent in the known types of games of skill and chance now present in the prior art, the present invention provides a new Method of Playing a Modified Poker Game wherein the same can be utilized for providing entertainment and a wagering opportunity to at least two players.

The general purpose of the present invention, which will be described subsequently in greater detail, is to provide a new Method of Playing a Modified Poker Game apparatus and method which has many of the advantages of the games of skill and chance mentioned heretofore and many novel features that result in a new Method of Playing a Modified Poker Game which is not anticipated, rendered obvious, suggested, or even implied by any of the prior art games of skill and chance, either alone or in any combination thereof.

To attain this, the present invention generally comprises the steps of:

selecting one player to act as a dealer;

the dealer determining a betting amount;

each player including the dealer anteing the betting amount;

the dealer dealing face up from a pre-determined number of decks a hand comprising a first pre-determined number of cards to each player including himself;

each player comparing their hand to each of the hands of the other players using poker rank as the criterion for comparison;

the player with the hand having the highest poker rank collecting the anted betting amount from each of the other players;

the dealer dealing a second pre-determined number of cards equal to the first pre-determined number of cards one at a time;

for each of the second pre-determined number of cards drawn by the dealer, each player comparing the drawn card to their hand;

for each card in each player's hand having an equivalent denomination to a card in the second pre-determined number of cards, each player setting aside an amount corresponding to the betting amount multiplied by a pre-determined rank order, the amount so set aside adding up to a set aside amount;

the dealer dealing a third pre-determined number of cards equal to the first pre-determined number of cards one at a time;

for each of the third pre-determined number of cards drawn by the dealer, each player comparing the drawn card to their hand;

for each card in each player's hand having an equivalent denomination to a card in the third pre-determined number of cards, each player withdrawing from his set aside amount an amount corresponding to the betting amount multiplied by the pre-determined rank order, provided that, in the event the set aside amount is less than the amount corresponding to the betting amount multiplied by the pre-determined rank order, the dealer paying the player the difference, any amount remaining constituting a net set aside amount;

the dealer collecting from each player their set aside amount;

the dealer dealing a plurality of cards one at a time;

each player comparing their hand with the cards drawn and covering each card in their hand with a token representative of the betting amount as a card having an equivalent denomination is drawn until at least one winning player has covered all the cards in his hand;

the winning players signifying the covering of all of their cards and collecting an equal distribution of the tokens covering each of the player's cards;

the dealer dealing up to thirteen cards, one at a time, for each card so dealt, the dealer trying to guess its' denomination;

the dealer having the option of collecting from each player the value of a card guessed correctly multiplied by the betting amount or continuing until all thirteen cards are dealt, the dealer collecting at most once from the each player; and wherein aces are valued at one, kings are valued at thirteen, queens are valued at twelve, jack are valued at eleven and all remaining cards are valued at their face value.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Method of Playing a Modified Poker Game apparatus and method which has many of the advantages of the games of skill and chance mentioned heretofore and many novel features that result in a new Method of Playing a Modified Poker Game which is not anticipated, rendered obvious, suggested, or even implied by any of the prior art games of skill and chance, either alone or in any combination thereof.

It is another object of the present invention to provide a new Method of Playing a Modified Poker Game which may be easily and efficiently manufactured and marketed.

It is a further object of the present invention to provide a new apparatus and Method of Playing a Modified Poker Game which is of a durable and reliable construction.

An even further object of the present invention is to provide a new apparatus and Method of Playing a Modified Poker Game which is susceptible of a low cost of manufacture with regard to both materials and labor, and which accordingly is then susceptible of low prices of sale to the consuming public, thereby making such Method of Playing a Modified Poker Game economically available to the buying public.

Still yet another object of the present invention is to provide a new Method of Playing a Modified Poker Game which provides in the apparatuses and methods of the prior art some of the advantages thereof, while simultaneously overcoming some of the disadvantages normally associated therewith.

Still another object of the present invention is to provide a new Method of Playing a Modified Poker Game for providing entertainment and a wagering opportunity to at least two players.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective view of the token cups and of two decks of playing cards.

FIG. 3 is a perspective view of the tokens of the present invention.

FIG. 4 is a plan view of a poker hand.

DESCRIPTION OF THE PREFERRED EMBODIMENT

Figure 1:
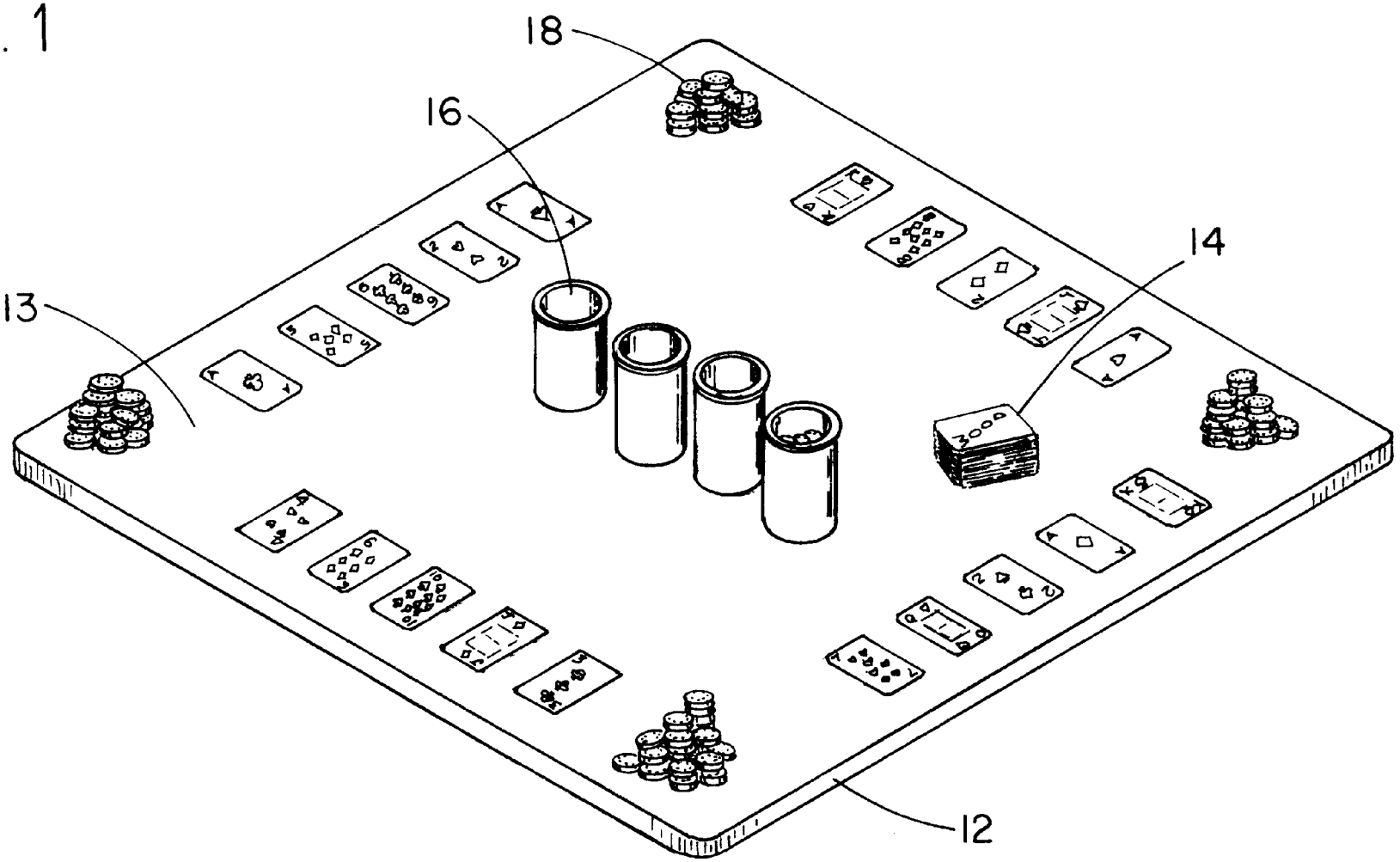
FIG. 1 is a perspective view of the game board showing the placement of the playing cards, tokens and token cups thereon according to the present invention.

With reference now to the drawings, and in particular to FIGS. 1 through 4 thereof, a new Method of Playing a Modified Poker Game embodying the principles and concepts of the present invention will be described.

More specifically, it will be noted that the game apparatus comprises a game board 12 having an upper playing surface 13. At least two decks of playing cards 14 are provided as well as tokens 18 representative of betting amounts and token cups 16 for holding the set aside amounts and net set aside amounts.

To play the modified poker game requires that one player be selected as a dealer. Next the dealer determines a betting amount. This betting amount is anted by the remaining players using tokens representative of the betting amount. The dealer then deals face up a hand to each player including himself, the hand comprising a first predetermined number of cards, which in the preferred embodiment is five. Each player compares his hand to each of the hands of the other players using poker rank as the criterion for comparison and the player with the hand having the highest poker rank collects the anted betting amount from each of the other players.

The dealer then deals a second pre-determined number of cards equal to the first pre-determined number of cards one at a time. For each of the second pre-determined number of cards drawn by the dealer, each player compares the drawn card to the cards in their hand. For each card in each player's hand having an equivalent denomination to a card in the second pre-determined number of cards, each player sets aside an amount corresponding to the betting amount multiplied by a pre-determined rank order, the amount set aside adding up to a set aside amount. The preferred rank order is sequential, the first card drawn corresponding to one, the second card drawn corresponding to two and so on. Thus if the first of the second pre-determined number of cards is a Jack, each player having a Jack in his hand sets aside the betting amount. If the second of the second pre-determined number of cards is a three, each player having a three in his hand sets aside twice the betting amount.

Next the dealer deals a third pre-determined number of cards equal to the first pre-determined number of cards one at a time. For each of the third pre-determined number of cards drawn by the dealer, each player compares the drawn card to his hand. For each card in each player's hand having an equivalent denomination to a card in the third pre-determined number of cards, each player withdraws from his set aside amount an amount corresponding to the betting amount multiplied by the pre-determined rank order. In the case of the set aside amount being less than the amount corresponding to the betting amount multiplied by the pre-determined rank order, the dealer pays the player the difference from his own funds. In the event any amount remains in the set aside amount, this amount constitutes a net set aside amount and is collected from each player by the dealer.

The dealer then deals a plurality of cards one at a time. Each player compares his hand with the cards drawn and covers each card in his hand with a token representative of the betting amount as a card having an equivalent denomination is drawn until at least one winning player has covered all the cards in his hand. The winning player or players then signify the covering of all of their cards by for example shouting out "Hollywood, Hollywood, Hollywood" and collect equal distribution of the tokens covering the cards in each player's hand.

Finally, the dealer deals up to thirteen cards, one at a time and for each card tries to guess it's denomination. The dealer has the option of collecting from each player the value of a card guessed correctly multiplied by the betting amount or continuing until all thirteen cards are dealt, the dealer collecting at most once from the each player. The value of the cards are determined as follows: Ace—1, King—13, Queen—12, Jack—11, and all other cards valued at their face value.

As to a further discussion of the manner of playing of the present invention, the same should be apparent from the above description. Accordingly, no further discussion relating to the manner of playing will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Method of Playing a Modified Poker Game involving a plurality of players comprising the steps of:

selecting one player to act as a dealer;

the dealer determining a betting amount;

each player including the dealer anteing the betting amount;

the dealer dealing face up from a pre-determined number of decks a hand comprising a first pre-determined number of cards to each player including himself;

each player comparing their hand to each of the hands of the other players using poker rank as the criterion for comparison;

the player with the hand having the highest poker rank collecting the anted betting amount from each of the other players;

the dealer dealing a second pre-determined number of cards equal to the first pre-determined number of cards one at a time;

for each of the second pre-determined number of cards drawn by the dealer, each player comparing the drawn card to their hand;

for each card in each player's hand having an equivalent denomination to a card in the second pre-determined number of cards, each player setting aside an amount corresponding to the betting amount multiplied by a pre-determined rank order, the amount so set aside adding up to a set aside amount;

the dealer dealing a third pre-determined number of cards equal to the first pre-determined number of cards one at a time;

for each of the third pre-determined number of cards drawn by the dealer, each player comparing the drawn card to their hand;

for each card in each player's hand having an equivalent denomination to a card in the third pre-determined number of cards, each player withdrawing from his set aside amount an amount corresponding to the betting amount multiplied by the pre-determined rank order, provided that, in the event the set aside amount is less than the amount corresponding to the betting amount multiplied by the pre-determined rank order, the dealer paying the player the difference, any amount remaining constituting a net set aside amount;

the dealer collecting from each player their set aside amount;

the dealer dealing a plurality of cards one at a time;

each player comparing their hand with the cards drawn and covering each card in their hand with a token representative of the betting amount as a card having an equivalent denomination is drawn until at least one winning player has covered all the cards in his hand;

the winning players signifying the covering of all of their cards and collecting an equal distribution of the tokens covering each of the player's cards;

the dealer dealing up to thirteen cards, one at a time, for each card so dealt, the dealer trying to guess its' denomination;

the dealer having the option of collecting from each player the value of a card guessed correctly multiplied by the betting amount or continuing until all thirteen cards are dealt, the dealer collecting at most once from the each player; and wherein aces are valued at one, kings are valued at thirteen, queens are valued at twelve, jack are valued at eleven and all remaining cards are valued at their face value.

2. The Method of Playing a Modified Poker Game of claim 1, wherein the pre-determined number of decks is two.

3. The Method of Playing a Modified Poker Game of claim 1, wherein the first pre-determined number of cards is five.

4. The Method of Playing a Modified Poker Game of claim 1, wherein the betting amount is represented by a plurality of tokens.

5. The Method of Playing a Modified Poker Game of claim 1, wherein the pre-determined rank order is sequential, the first drawn card corresponding to one, the second drawn card corresponding to two and so on.

* * * * *